US008967759B2

(12) United States Patent
Masaoka et al.

(10) Patent No.: US 8,967,759 B2
(45) **Date of Patent: *Mar. 3, 2015**

(54) IMAGE FORMING APPARATUS

(71) Applicant: Ricoh Company, Ltd., Tokyo (JP)

(72) Inventors: Shingo Masaoka, Kanagawa (JP); Shotaro Takeuchi, Kanagawa (JP); Masahiko Hisada, Kanagawa (JP); Kyohei Matsumura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/190,182

(22) Filed: Feb. 26, 2014

(65) Prior Publication Data

US 2014/0253626 A1 Sep. 11, 2014

(30) Foreign Application Priority Data

Mar. 7, 2013 (JP) ..... 2013-045956

(51) Int. Cl.
*B41J 29/393* (2006.01)
*B41J 2/165* (2006.01)
*B41J 29/17* (2006.01)

(52) U.S. Cl.
CPC ..... *B41J 2/16579* (2013.01); *B41J 29/17* (2013.01)
USPC ..... 347/19; 347/31; 347/33

(58) Field of Classification Search
CPC ..... B41J 2/16541; B41J 2/16579; B41J 2/16588; B41J 2002/16594; B41J 2002/16597
USPC ..... 347/19, 20, 22, 31–33
See application file for complete search history.

(56) References Cited

U.S. PATENT DOCUMENTS

| | | | | |
|---|---|---|---|---|
| 7,883,175 | B2 * | 2/2011 | Otsuka et al. | 347/32 |
| 8,622,515 | B2 * | 1/2014 | Yanase et al. | 347/34 |
| 2009/0256892 | A1 | 10/2009 | Takeuchi | |
| 2010/0002048 | A1 | 1/2010 | Masaoka | |
| 2010/0171799 | A1 | 7/2010 | Takeuchi et al. | |
| 2011/0057997 | A1 | 3/2011 | Takeuchi | |

FOREIGN PATENT DOCUMENTS

| | | |
|---|---|---|
| JP | 2004-306475 | 11/2004 |
| JP | 2007-050533 | 3/2007 |

OTHER PUBLICATIONS

U.S. Appl. No. 14/075,128, filed Nov. 8, 2013.

* cited by examiner

*Primary Examiner* — An Do
(74) *Attorney, Agent, or Firm* — Cooper & Dunham LLP

(57) ABSTRACT

An image forming apparatus includes a recording head, an ejection detection unit, a cleaner, and a holder member. The ejection detection unit has an electrode member disposed in an area in which the electrode member is opposable to the head. The cleaner includes a cleaning member to remove droplets adhering to the electrode member. The ejection detection unit detects ejection or non-ejection of droplets by detection of electric changes of the electrode member generated when droplets ejected from nozzles of the head land on the electrode member in a state in which a potential difference is created between a nozzle face of the head and the electrode member and the nozzle face is opposed to the electrode member. The holder member supports the electrode member, and holds the cleaning member movable in parallel to a nozzle array direction in which the nozzles is arrayed in the head.

6 Claims, 11 Drawing Sheets

IMAGE FORMING APPARATUS

CROSS-REFERENCE TO RELATED APPLICATIONS

This patent application is based on and claims priority pursuant to 35 U.S.C. §119 to Japanese Patent Application No. 2013-045956, filed on Mar. 7, 2013, in the Japan Patent Office, the entire disclosure of which is hereby incorporated by reference herein.

BACKGROUND

1. Technical Field

Embodiments of this disclosure relate to an image forming apparatus.

2. Description of the Related Art

Image forming apparatuses are used as printers, facsimile machines, copiers, plotters, or multi-functional devices having at least one of the foregoing capabilities. As one type of image forming apparatus employing a liquid-ejection recording method, inkjet recording apparatuses are known that use a recording head (liquid ejection head or liquid-droplet ejection head) for ejecting droplets of ink or other liquid.

For example, a liquid-ejection type image forming apparatus has an ejection detector to detect a state of droplet ejection from a recording head. When faulty droplet ejection is detected on a nozzle(s), the image forming apparatus performs maintenance and recovery operation (maintenance operation) on the recording head, such as cleaning of a nozzle face.

For example, an ejection detector detects ejection or non-ejection by measuring an electric change when liquid droplets ejected from a recording head land on an electrode plate (see JP-2007-050533-A).

In addition, JP-2004-306475-A proposes to clean such an electrode plate by a wiping member to wipe the plate in the same direction as a moving direction of a carriage.

For the above-described configuration in which detection or non-detection is detected based on an electric change generated by liquid droplets ejected onto an electrode plate, liquid droplets adhere to the electrode plate in the detection of droplet ejection. Such liquid droplets ejected from nozzles of the recording head in the detection of droplet ejection are a minute amount of droplets.

Thus, as described in JP-2004-306475-A, even when a wiping member wipes the electrode plate in the same direction as the moving direction of the carriage, that is, in a direction perpendicular to a nozzle array direction in which nozzles are arrayed in the recording head, droplets may not be collected on the wiping member, thus adhering the wiping member as separate droplets.

As a result, waste liquid adhering to the wiping member may solidify, thus reducing the wiping performance of the wiping member and hampering cleaning of the electrode plate and accurate ejection detection.

BRIEF SUMMARY

In at least one exemplary embodiment of this disclosure, there is provided an image forming apparatus including a recording head, an ejection detection unit, a cleaner, and a holder member. The recording head has a plurality of nozzles to eject droplets and a nozzle face in which the plurality of nozzles is formed. The ejection detection unit detects ejection or non-ejection of the droplets from the plurality of nozzles of the recording head. The ejection detection unit has an electrode member disposed in an area in which the electrode member is opposable to the recording head. The droplets ejected from the plurality of nozzles of the recording head land on the electrode member. The cleaner cleans the electrode member. The cleaner includes a cleaning member to remove droplets adhering to the electrode member. The ejection detection unit detects ejection or non-ejection of the droplets from the plurality of nozzles by detection of electric changes of the electrode member generated when the droplets ejected from the plurality of nozzles of the recording head land on the electrode member in a state in which a potential difference is created between the nozzle face of the recording head and the electrode member and the nozzle face of the recording head is opposed to the electrode member. The holder member supports the electrode member, and holds the cleaning member movable in parallel to a nozzle array direction in which the plurality of nozzles is arrayed in the recording head.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
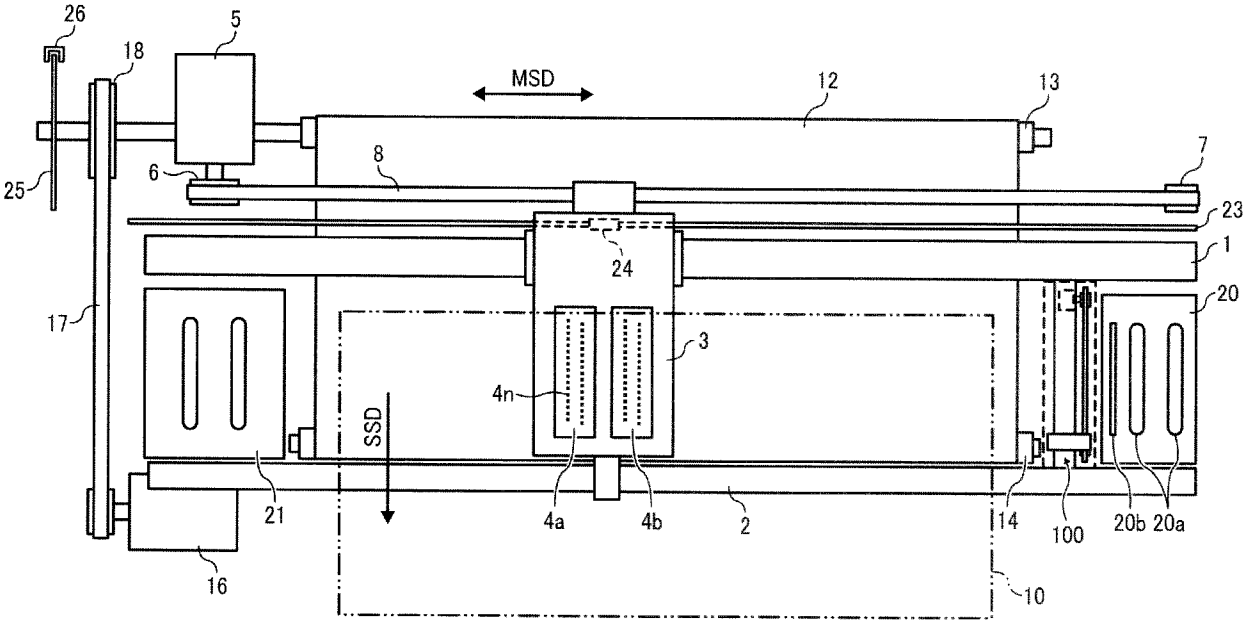
FIG. 1 is a plan view of a mechanical section of an image forming apparatus according to an exemplary embodiment of this disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

For example, in this disclosure, the term "sheet" used herein is not limited to a sheet of paper and includes anything such as OHP (overhead projector) sheet, cloth sheet, glass sheet, or substrate on which ink or other liquid droplets can be attached. In other words, the term "sheet" is used as a generic term including a recording medium, a recorded medium, a recording sheet, and a recording sheet of paper. The terms "image formation", "recording", "printing", "image recording" and "image printing" are used herein as synonyms for one another.

The term "image forming apparatus" refers to an apparatus that ejects liquid on a medium to form an mage on the medium. The medium is made of, for example, paper, string, fiber, cloth, leather, metal, plastic, glass, timber, and ceramic. The term "image formation" includes providing not only meaningful images such as characters and figures but meaningless images such as patterns to the medium (in other words, the term "image formation" also includes only causing liquid droplets to land on the medium).

The term "ink" is not limited to "ink" in a narrow sense, unless specified, but is used as a generic term for any types of liquid usable as targets of image formation. For example, the term "ink" includes recording liquid, fixing solution, DNA sample, resist, pattern material, resin, and so on.

The term "image" used herein is not limited to a two-dimensional image and includes, for example, an image applied to a three dimensional object and a three dimensional object itself formed as a three-dimensionally molded image.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, wherein like reference numerals designate identical or corresponding parts throughout the several views, exemplary embodiments of the present disclosure are described below.

Below, an image forming apparatus according to some exemplary embodiments of this disclosure is described below with reference to FIGS. 1 and 2.

FIG. 1 is a partial plan view of a mechanical section of an image forming apparatus according to an exemplary embodiment of this disclosure. FIG. 2 is a partial side view of the mechanical section illustrated in FIG. 1.

In this embodiment, the image forming apparatus is a serial-type inkjet recording apparatus. In the image forming apparatus, a carriage 3 is supported by a main guide member 1 and a sub guide rod 2 so as to be movable in a direction (main scanning direction) indicated by an arrow MSD in FIG. 1. The main guide member 1 and the sub guide member 2 extend between left and right side plates. A main scanning motor 5 reciprocally moves the carriage 3 for scanning in the main scanning direction MSD via a timing belt 8 extending between a driving pulley 6 and a driven pulley 7.

The carriage 3 mounts recording heads 4*a* and 4*b* (collectively referred to as "recording heads 4" unless distinguished) serving as liquid ejection heads for ejecting liquid droplets. The recording heads 4 eject, for example, ink droplets of different colors, such as yellow (Y), cyan (C), magenta (M), and black (K). The carriage 3 mounts the recording heads 4 so that nozzle rows, each of which includes multiple nozzles 4*n*, are arranged in a sub scanning direction (indicated by an arrow SSD in FIG. 1) perpendicular to the main scanning direction MSD and ink droplets are ejected downward from the nozzles.

Figure 3:
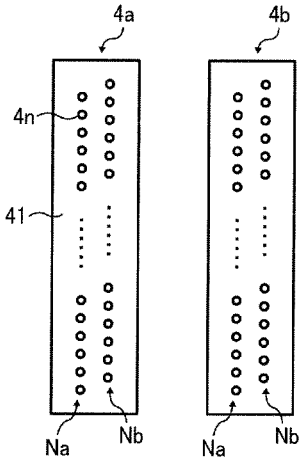
FIG. 3 is a schematic view of recording heads of the image forming apparatus according to an exemplary embodiment of this disclosure.

As illustrated in FIG. 3, each recording head 4 has two nozzle rows Na and Nb, each of which is formed of multiple nozzles 4*n*. For example, one (nozzle row Na) of the nozzle rows of the recording head 4*a* ejects droplets of black (K), and the other (nozzle row Nb) ejects droplets of cyan (C). One (nozzle row Na) of the nozzle rows of the recording head 4*a* ejects droplets of magenta (M), and the other (nozzle row Nb) ejects droplets of yellow (Y).

For example, piezoelectric actuators such as piezoelectric elements or thermal actuators that generate film boiling of liquid (ink) using electro/thermal converting elements, such as heat-generation resistant, to cause a phase change may be employed as the liquid ejection heads forming the recording heads 4.

The carriage 3 mounts head tanks 40 to temporarily store ink to be supplied to the recording heads 4. Different color inks are supplied from ink cartridges (main tanks) to the head tanks 40.

The image forming apparatus has a conveyance belt 12 serving as a conveyance device to convey a sheet 10 at a position opposing the recording heads 4 while adhering the sheet 10 thereon by static electricity. The conveyance belt 12 is an endless belt that is looped between a conveyance roller 13 and a tension roller 14.

The conveyance roller 13 is rotated by a sub-scanning motor 16 via a timing belt 17 and a timing pulley 18 to circulate the conveyance belt 12 in the sub-scanning direction SSD illustrated in FIG. 1. A charging roller 31 charges (supplies electric charges to) the conveyance belt 12 during circulation of the conveyance belt 12.

At one end in the main scanning direction MSD of the carriage 3, a maintenance assembly (maintenance-and-recovery assembly) 20 is disposed near a lateral side of the conveyance belt 12 to perform maintenance and recovery on the recording heads 4. At the opposite end in the main scanning direction MSD, a first dummy ejection receptacle 21 is disposed at the opposite lateral side of the conveyance belt 12 to receive liquid droplets ejected from the recording heads 4 by dummy ejection in which liquid droplets not contributing to image formation are ejected for maintenance, e.g., removal of viscosity-increased liquid or bubbles.

The maintenance assembly 20 includes cap members 20*a* to cap, for example, nozzle faces (nozzle formed faces) 41 of the recording heads 4, a wiper member 20*b* to wipe the nozzle faces 41, and a second dummy ejection receptacle to store liquid droplets not contributing to image formation.

An ejection detection unit 100 includes an ejection detector to detect ejection and non-ejection of droplets and a cleaner according to an exemplary embodiment of this disclosure. The ejection detection unit 100 is disposed in an area outside a recording region between the conveyance belt 12 and the maintenance assembly 20, in which the ejection detection unit 100 can oppose the recording heads 4.

An encoder scale 23 having a predetermined pattern extends between the side plates along the main scanning direction MSD of the carriage 3, and the carriage 3 has a main-scanning encoder sensor 24 serving as a transmissive photosensor to read the pattern of the encoder scale 23. The encoder scale 23 and the main-scanning encoder sensor 24 form a linear encoder (main scanning encoder) to detect movement of the carriage 3.

A code wheel 25 is mounted on a shaft of the conveyance roller 13, and a sub-scanning encoder sensor 26 serving as a transmissive photosensor is provided to detect a pattern of the code wheel 25. The code wheel 25 and the sub-scanning encoder sensor 26 form a rotary encoder (sub scanning encoder) to detect the movement amount and movement position of the conveyance belt 12.

Figure 2:
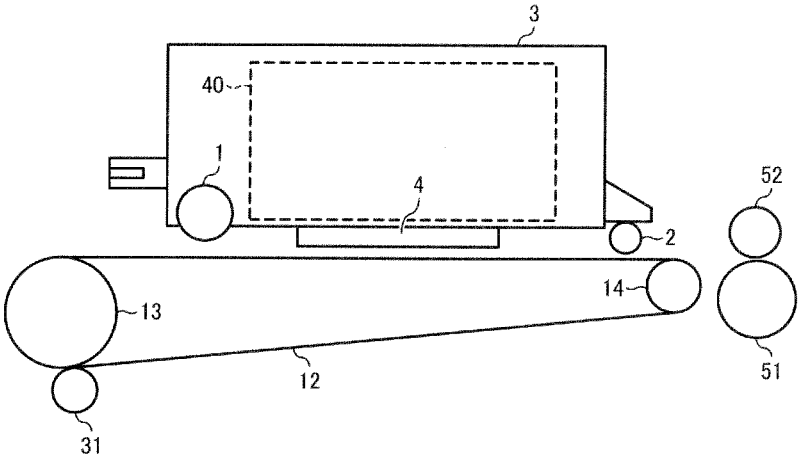
FIG. 2 is a partial side view of the mechanical section illustrated in FIG. 1.

In addition, as illustrated in FIG. 2, a discharge roller 51 and a spur roller 52 are disposed at a downstream side of the conveyance belt 12 from the driven roller 14. The discharge roller 51 and the spur roller 52 feed, to an output tray, a sheet 10 having an image formed thereon.

In the image forming apparatus having the above-described configuration, a sheet 10 is fed from a sheet feed tray, attached on the conveyance belt 12 charged, and conveyed in the sub-scanning direction SSD with the circulation of the conveyance belt 12.

By driving the recording heads 4 in response to image signals while moving the carriage 3 in the main scanning direction MSD, ink droplets are ejected onto the sheet 10 stopped to form one line of a desired image. Then, the sheet 10 is fed by a certain distance to prepare for the next operation to record another line of the image. Receiving a signal indicating that the image recording has been completed or a rear end of the sheet 10 has arrived at the recording region, the image forming apparatus finishes the recording operation and outputs the sheet 10 to a sheet output tray.

Next, a mounting structure of an ejection detection unit according to an exemplary embodiment is described with reference to FIG. 4.

Figure 4:
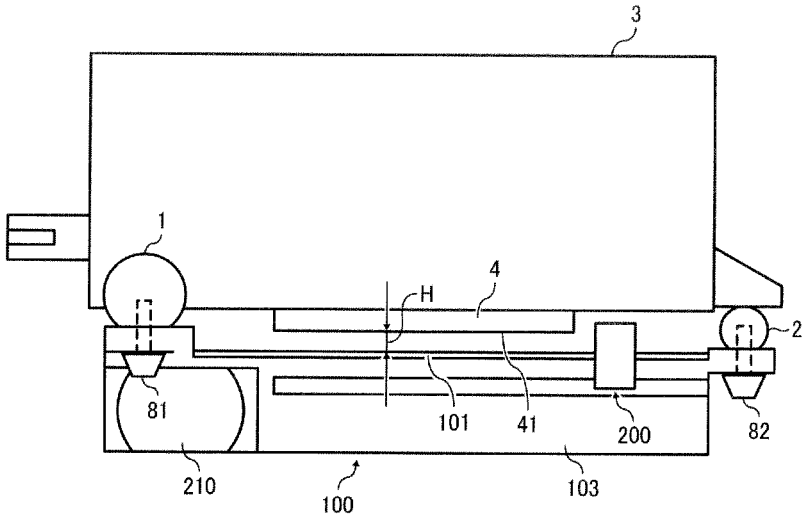
FIG. 4 is a side view of a mounting structure of an ejection detection unit of the image forming apparatus according to an exemplary embodiment of this disclosure.

FIG. 4 is a side view of an ejection detection unit 100 according to an exemplary embodiment of this disclosure.

The ejection detection unit 100 includes an electrode plate 101 and a holder member 103. The electrode plate 101 serves as an electrode member on which liquid droplets from the recording heads 4 for ejection detection adhere. The holder member 103 serves as a holding member to hold the electrode plate 101 thereon, and is made of an insulation material, such as plastic.

The electrode plate 101 is preferably, for example, a conductive metal plate made of a material which is rustproof and resistant to ink. The electrode plate 101 may be, for example, stainless steel (SUS) 304 or copper alloy plated with nickel (Ni) or palladium (Pd). A surface of the electrode plate 101 on which liquid droplets adhere is preferably finished to be water repellent.

Here, to detect droplet ejection at stable detection accuracy, a clearance H between the nozzle face 41 of each recording head 4 and the electrode plate 101 is preferably maintained constant regardless of the positions of the nozzles.

Hence, in this embodiment, the holder member 103 is fastened to the main guide member 1 and the sub guide member 2, which support the carriage 3, with screws 81 and 82, respectively.

Such a configuration allows the clearance H between the nozzle face 41 of each recording head 4 and the electrode plate 101 to be maintained constant regardless of the positions of the nozzles, thus stabilizing detection accuracy.

Next, an outline of a controller of an image forming apparatus according to an exemplary embodiment is described with reference to FIG. 5.

Figure 5:
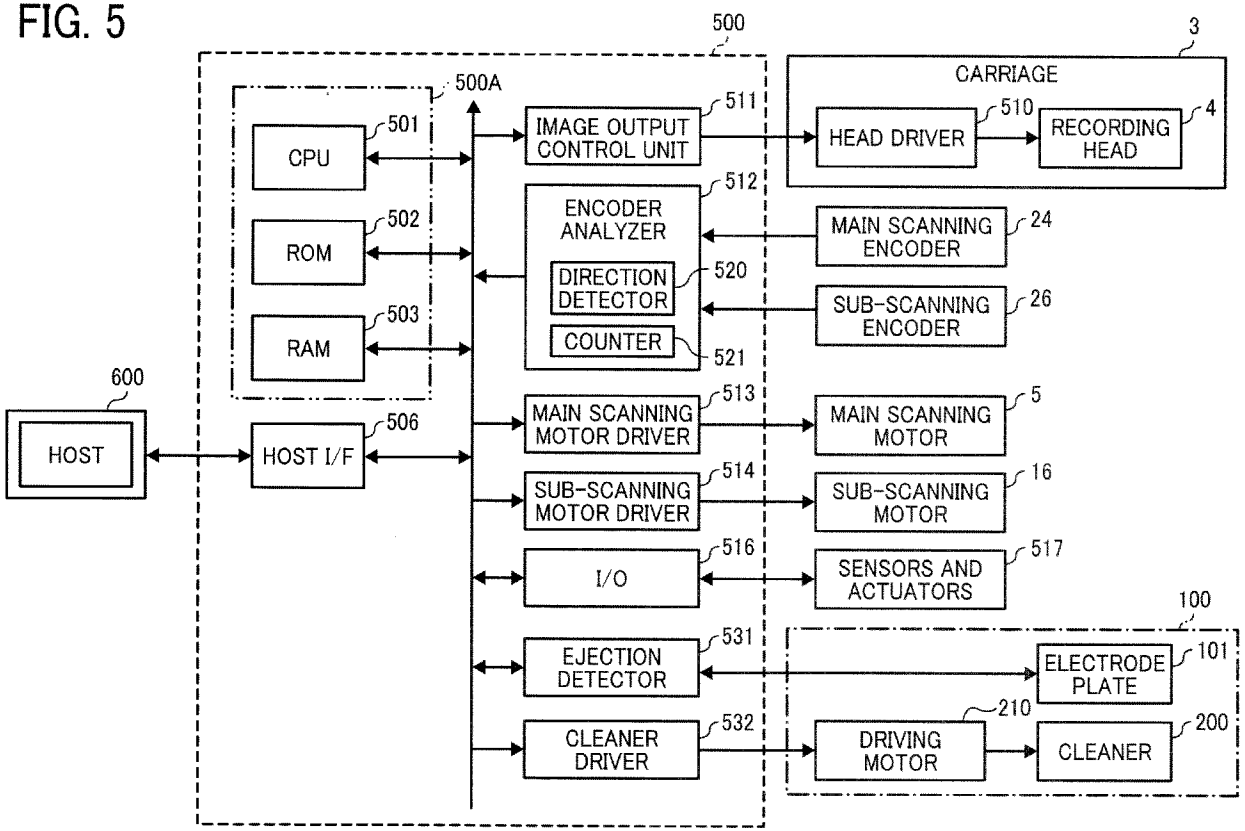
FIG. 5 is a block diagram of a controller of the image forming apparatus according to an exemplary embodiment of this disclosure.

FIG. 5 is a block diagram of a controller 500 of an image forming apparatus according to an exemplary embodiment.

The controller 500 includes a main control unit 500A including a central processing unit (CPU) 501, a read-only memory (ROM) 502, and a random access memory (RAM) 503. The CPU 501 controls the entire image forming apparatus. The ROM 502 stores programs executed by the CPU 501 and other Fixed data. The RAM 503 temporarily stores image data and other data.

The controller 500 has a host interface (IT) 506 to transmit and receive data to and from a host (information processing device) 600, such as a personal computer (PC), an image output control unit 511 to control driving of the recording heads 4, and an encoder analyzer 512. The encoder analyzer 512 receives and analyzes detection signals from the main-scanning encoder sensor 24 and the sub-scanning encoder sensor 26.

The controller 500 includes a main-scanning motor driver 513 to drive the main scan motor 5, a sub scanning motor driver 514 to drive the sub-scanning motor 16, and an input/output (I/O) unit 516 between various sensors and actuators 517.

The controller 500 also includes an ejection detector 531 to measure (detect) electric changes caused when liquid droplets land on the electrode plate 101 of the ejection detection unit 100 to determine ejection or non-ejection. The controller 500 further includes a cleaner driver 532 to drive a driving motor 210 to move a cleaner 200. The cleaner 200 cleans the electrode plate 101 of the ejection detection unit 100.

The image output control unit 511 includes a data generator to generate print data, a driving waveform generator to generate driving waveforms to control driving of the recording heads 4, and a data transmitter to transmit print data and head control signals for selecting desired driving signals from the driving waveforms. The image output control unit 511 outputs the driving waveforms, the head control signals, print data and so on to a head driver 51, which is a head driving circuit for driving the recording heads 4 mounted on the carriage 3, to eject liquid droplets from nozzles of the recording heads 4 in accordance with print data.

The encoder analyzer 512 includes a direction detector 520 to detect a movement direction of the carriage 3 from detection signals and a counter 521 to detect a movement amount of the carriage 3.

Based on analysis results transmitted from the encoder analyzer 512, the controller 500 controls driving of the main scanning motor 5 via a the main scanning motor driver 513 to control movement of the carriage 3. The controller 500 also controls driving of the sub-scanning motor 16 via a sub scanning motor driver 514 to control feeding of the sheet 10.

In detection of ejection of droplets from the recording heads 4, the main control unit 500A of the controller 500 controls the recording heads 4 to move and eject droplets from desired nozzles of the recording heads 4, and determines droplet ejection states based on detection signals from the ejection detector 531.

Figure 6:
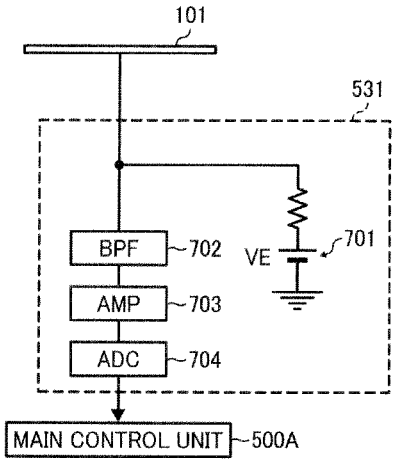
FIG. 6 is a block diagram of an ejection detector of the controller according to an exemplary embodiment of this disclosure.

Next, an outline of the ejection detector 531 according to an exemplary embodiment of this disclosure is described with reference to FIG. 6.

The electrode plate 101 onto which liquid droplets for ejection detection are ejected from the recording heads 4 is connected to the ejection detector 531. The ejection detector 531 has a high-voltage power source 701 to supply a high voltage VE (e.g., 750V) to the electrode plate 101. The main control unit 500A control on and off states of the high-voltage power source 701.

The ejection detector 531 also has a band pass filter (BPF) 702 to input signals involving electric changes when liquid droplets land on the electrode plate 101, an amplification (AMP) circuit 703 to amplify the signals, and an analog-digital converter (ADC) 704 to convert the amplified signals from analog format to digital format. Resultant converted signals of the ADC 704 are input to the main control unit 500A.

When ejection detection is performed, the nozzle face 41 of one of the recording heads 4 is placed to oppose the electrode plate 101. A high voltage VE is supplied to the electrode plate 101 to generate a potential difference between the nozzle face 41 and the electrode plate 101. At this time, the nozzle face 41 of the recording head 4 is negatively charged while the electrode plate 101 is positively charged.

In such a state, a liquid droplet(s) for ejection detection is (are) ejected from each nozzle of the recording heads 4.

At this time, since liquid droplets are ejected from the nozzle face 41 negatively charged, the liquid droplets are also negatively charged. When the liquid droplets negatively charged land on the electrode plate 101, the voltage of the high voltage VE supplied to the electrode plate 101 slightly changes.

The band-pass filter 702 extracts the voltage change (alternative current (AC) component) and the amplification circuit 703 amplifies the AC component. The ADC 704 converts the amplified component from analog format to digital format and inputs the converted data as a measurement result (detection result) to the main control unit 500A.

The main control unit 500A determines whether the measurement result (voltage change) is greater than a preset threshold value, and if the measurement result is greater than the threshold value, the main control unit 500A determines that a detected nozzle of the recording heads 4 has ejected a liquid droplet(s). By contrast, if the measurement result is not greater than the threshold value, the main control unit 500A determines that a detected nozzle of the recording heads 4 has not ejected a liquid droplet(s).

In this embodiment, since a liquid droplet(s) is (are) ejected from each nozzle of the recording heads 4 to land on the electrode plate 101, it takes approximately 0.5 milliseconds (msec) to approximately 10 msec to determine ejection or non-ejection of a single nozzle. After ejection or non-ejection of all nozzles is determined, the high voltage VE supplied to the electrode plate 101 is turned into off state.

Next, an ejection detection unit according to an exemplary embodiment of this disclosure is described with reference to FIGS. 7 to 9.

Figure 7:
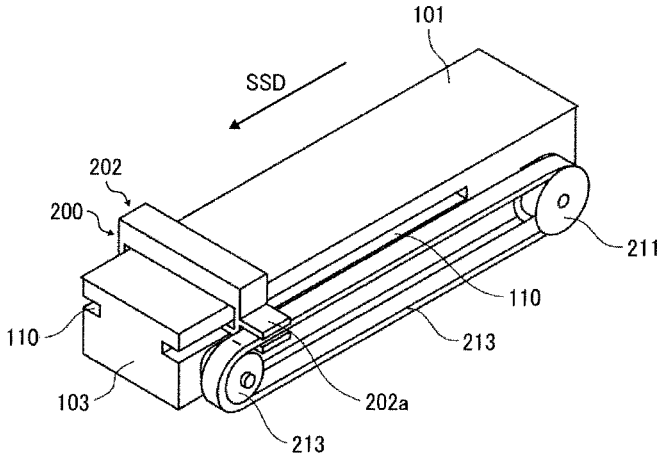
FIG. 7 is a perspective view of an ejection detection unit according to an exemplary embodiment of this disclosure.

FIG. 7 is a perspective view of an ejection detection unit according to an exemplary embodiment of this disclosure. FIG. 5 is a perspective view of the ejection detection unit of FIG. 7 seen from the opposite side of FIG. 7. FIG. 9 is a front view of the ejection detection unit of FIG. 7.

In this embodiment, the cleaner 200 includes a cleaning member 202 to contact a surface of an electrode plate 101 and remove droplets (waste liquid) adhering to the surface of the electrode plate 101 while scraping the droplets off.

The cleaning member 202 has a cleaning portion 203 and a guide portion 204. The cleaning portion 203 contacts a surface of the electrode plate 101. The guide portion 204 supports the cleaning portion 203 and movably engages a guide groove 110 formed at each side face of a holder member 103 in a nozzle array direction (sub-scanning direction) in which nozzles of a recording head are arrayed in line. In this embodiment, the cleaning portion 203 and the guide portion 204 are integrally molded as a single member.

A driving assembly to move the cleaning member 202 includes, e.g., a driving motor 210, a pulley 211, a pulley 212, and a driving belt 213. The driving motor 210 is disposed at an end of the holder member 103 in the sub-scanning direction. The pulley 211 is disposed on a motor shaft of the driving motor 210. The pulley 212 is disposed at the other end of the holder member 103 in the sub-scanning direction. The driving belt 213 is wound around and between the pulley 211 and the pulley 212.

The cleaning member 202 has a clamp portion 202*a* to sandwich and clamp the driving belt 213.

Thus, by driving the driving motor 210, the cleaning member 202 is reciprocally moved in the sub-scanning direction (i.e., a direction parallel to the nozzle array direction) to remove ink droplets landed on the surface of the electrode plate 101.

In this embodiment, the positions of a wiping surface (contact surface) of the cleaning portion 203 of the cleaning member 202 and the surface of the electrode plate 101 are defined by a distance L between an upper surface of the guide groove 110, which is formed at each side face of the holder member 103 in the nozzle array direction, and the wiping surface of the cleaning portion 203, which contacts the surface of the electrode plate 101. Here, the upper surface of the guide groove 110 serves as a reference surface RS. In other words, the positions of the wiping surface (contact surface) of the cleaning portion 203 of the cleaning member 202 and the surface of the electrode plate 101 are defined by only a dimension L of the cleaning member 202 and a dimension L of the holder member 103 including the electrode plate 101.

Such a configuration allows simple and accurate positioning of the distance between the cleaning member 202 and the electrode plate 101.

As a result, ink droplets ejected on the electrode plate 101 can be reliably removed, thus allowing ejection detecting performance to be maintained in good condition over a long period of time.

Next, an ejection detection unit according to an embodiment of this disclosure is described with reference to FIGS. 10 and 11.

Figure 10:
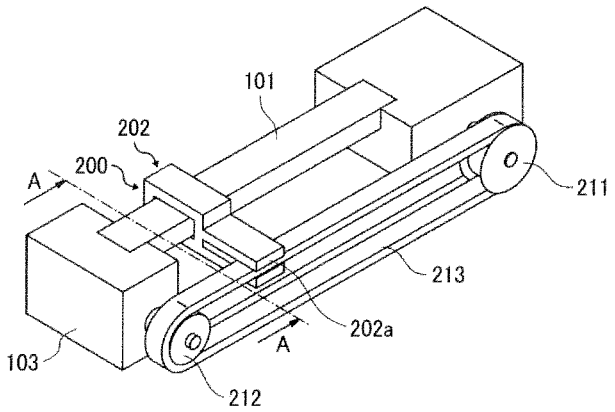
FIG. 10 is a perspective view of an ejection detection unit according to an exemplary embodiment of this disclosure.
Figure 11:
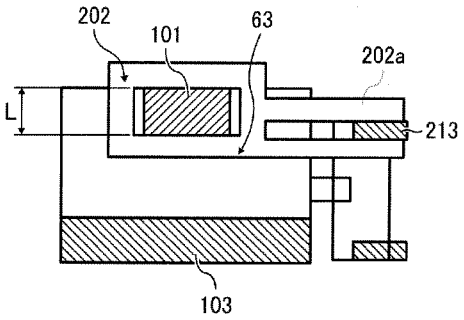
FIG. 11 is a cross-sectional view of the ejection detection unit cut along A-A line of FIG. 10.

FIG. 10 is a perspective view of an ejection detection unit according to an embodiment of this disclosure. FIG. 11 is a cross-sectional view of the ejection detection unit cut along A-A line of FIG. 10.

In this embodiment, an electrode plate 101 is a pillar-shaped member. The electrode plate 101 serving as a shaft is fitted in a hole of the cleaning member 202.

Such a shaft-hole configuration can position the cleaning member 202 without using the holder member 103, thus allowing more accurate positioning than the above-described embodiment.

Next, an ejection detection unit according to an embodiment of this disclosure is described with reference to FIG. 12.

Figure 12:
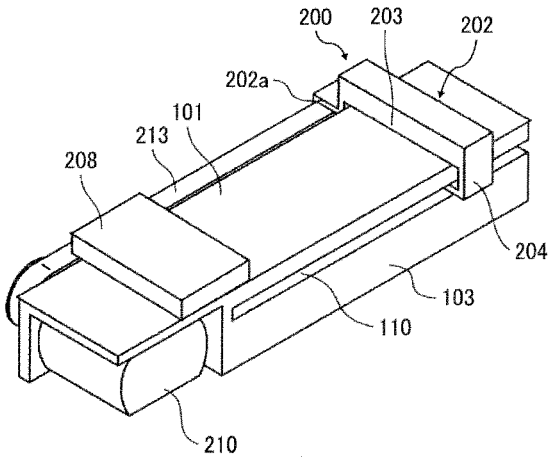
FIG. 12 is a perspective view of an ejection detection unit according to an exemplary embodiment of this disclosure.

FIG. 12 is a perspective view of an ejection detection unit according to an embodiment of this disclosure.

Figure 8:
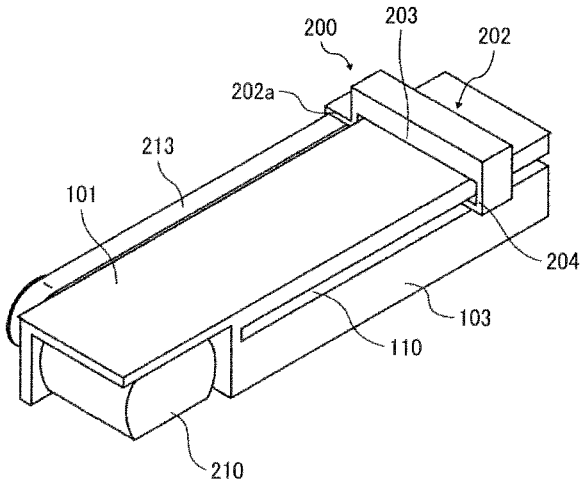
FIG. 8 is a perspective view of the ejection detection unit of FIG. 7 seen from an opposite side of FIG. 7.
Figure 9:
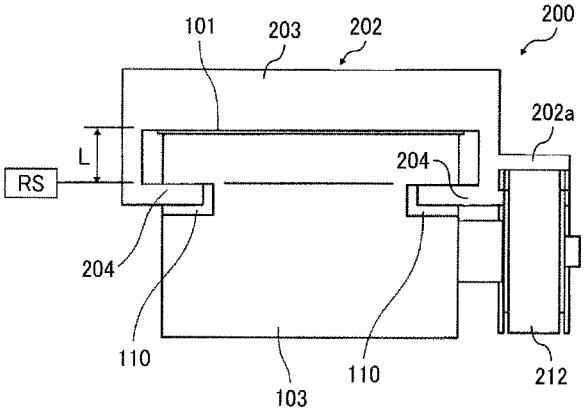
FIG. 9 is a partial front view of the ejection detection unit of FIG. 7.

For this embodiment, in the configuration of the above-described embodiment illustrated in FIGS. 7 to 9, an absorbing member 208 to absorb ink is disposed at a cleaning terminal side at which the cleaning member 202 finishes cleaning the electrode member 101.

The absorbing member 208 absorbs ink scraped off from the electrode plate 101 by the cleaning member 202, thus allowing the cleaning member 202 to be maintained in clear condition. Such a configuration can maintain cleaning performance in good condition over a longer period of time.

Next, an ejection detection unit according to an embodiment of this disclosure is described with reference to FIG. 13.

Figure 13:
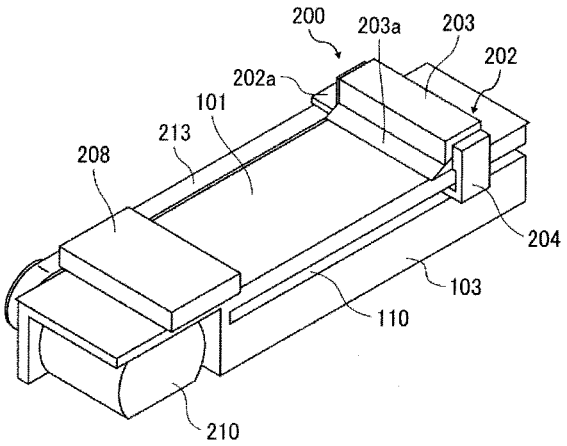
FIG. 13 is a perspective view of an ejection detection unit according to an exemplary embodiment of this disclosure.

FIG. 13 is a perspective view of an ejection detection unit according to an embodiment of this disclosure.

In this embodiment, a cleaner 200 has a cleaning portion 203 and a guide portion 204. The cleaning portion 203 contacts a surface of an electrode plate 101. The guide portion 204 supports the cleaning portion 203 and movably engages a guide groove 110 formed at each side face of a holder member 103 in a nozzle array direction (sub-scanning direction) in which nozzles of a recording head are arrayed in line. In this embodiment, the cleaning portion 203 and the guide portion 204 are formed as separate members.

The cleaning portion 203 has a slant surface 203*a* gradually rising upward from a leading edge to an opposite side of the leading edge in a cleaning direction of the cleaning member 202 in which the cleaning member 202 moves to remove ink droplets on the electrode plate 101.

Such a configuration can more reliably remove ink from the electrode plate 101.

Next, an ejection detection unit according to an embodiment of this disclosure is described with reference to FIG. 14.

Figure 14:
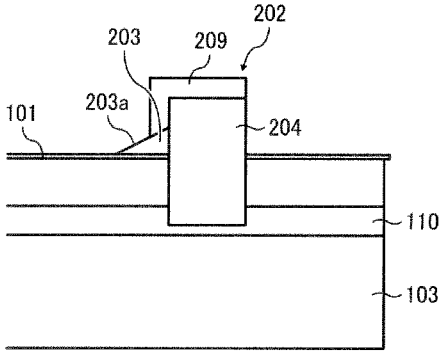
FIG. 14 is a partial side view of an ejection detection unit according to an exemplary embodiment of this disclosure.

FIG. 14 is a partial side view of an ejection detection unit according to an embodiment of this disclosure.

In this embodiment, in the configuration of the above-described embodiment illustrated in FIG. 13, an absorbing member 209 to absorb ink in disposed on an upper side of a slant surface 203*a* of a cleaning member 202.

Such a configuration can absorb ink, which is scraped upward along the slant surface 203*a*, with the absorbing member 209 and retain the ink in the absorbing member 209, thus allowing cleaning performance to be maintained over a longer period of time.

In any of the above-described embodiments, the surface of the cleaning member 202 opposing the electrode plate 101 is formed of an elastic member, such as rubber or elastomer. Even if the flatness of the electrode plate 101 is low to some degree, such a configuration allows the surface of the cleaning member 202 to follow and closely contact the surface of the electrode plate 101, thus allowing ink to be more reliably removed from on the electrode plate 101.

Next, an ejection detection unit according to an embodiment of this disclosure is described with reference to FIGS. 15 and 16.

Figure 15:
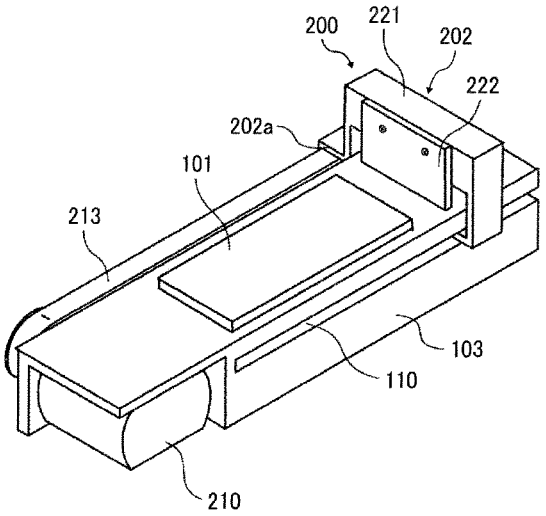
FIG. 15 is a perspective view of an ejection detection unit according to an exemplary embodiment of this disclosure.

FIG. 15 is a perspective view of an ejection detection unit according to an embodiment of this disclosure. FIG. 16 is a side view of the ejection detection unit during operation of a wiping member.

In this embodiment, an electrode plate 101 is fixedly mounted on a holder member 103 with a step between the electrode plate 101 and a surface of the holder member 103.

A cleaner 200 includes a wiper 222 to wipe and clean a surface of the electrode plate 101 and a wiper holder 221 to hold the wiper 222.

Here, for example, the wiper holder 221 is moved in parallel to the nozzle array direction along a guide groove 110 formed at each lateral side face of the holder member 103 in the nozzle array direction, as in the cleaning member 202 in any of the above-described embodiments.

Figure 16:
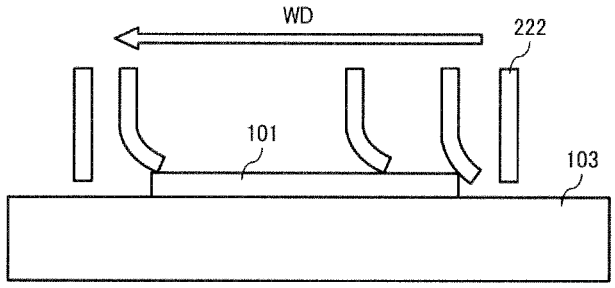
FIG. 16 is a side view of the ejection detection unit of FIG. 15 during operation of a wiping member.

As illustrated in FIG. 16, when the wiper 222 moves wiping direction WD, the wiper 222 is bent and an edge of the wiper 222 moves while sliding over the surface of the electrode plate 101 in contact with the surface of the electrode plate 101. Thus, the wiper 222 cleans the electrode plate 101 while scraping and collecting ink ejected on the electrode plate 101.

Next, an ejection detection unit according to an embodiment of this disclosure is described with reference to FIG. 17.

Figure 17:
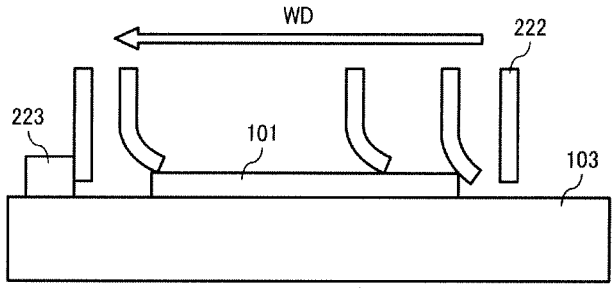
FIG. 17 is a side view of an ejection detection unit during operation of a wiping member according to an embodiment of this disclosure.

FIG. 17 is a side view of an ejection detection unit during operation of a wiping member according to an embodiment of this disclosure.

In this embodiment, in the configuration of the above-described embodiment illustrated in FIGS. 15 and 16, an absorbing member 223 is disposed at a position at which a wiper 222 arrives after the wiper 222 wipes out the surface of an electrode plate 101.

Accordingly, the absorbing member 223 absorbs and cleans ink adhering to the wiper 222 during wiping. Such a configuration allows the wiper 222 to be maintained in clean condition over a long period of time, thus allowing cleaning performance for the electrode plate 101 to be maintained in good condition.

It is to be noted that, in the above-described embodiments illustrated in FIGS. 15 and 16 and FIG. 17, the wiper 222 may wipe the electrode plate 101 in a direction opposite the wiping direction WD, or in both of the wiping direction WD and the opposite direction.

Next, a wiping direction WD of a wiper is described with reference to FIG*s*. 18A and 18B and FIGS. 19A and 19B.

Figure 18A:
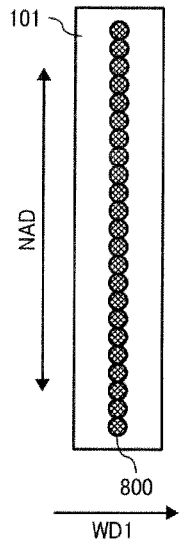
FIG. 18A is a plan view of a wiper during wiping operation according to a comparative example of this disclosure.
Figure 18B:
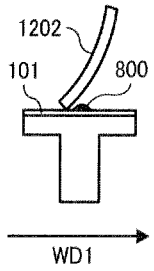
FIG. 18B is a side view of the wiper of FIG. 18A during wiping operation.

FIGS. 18A and 18B show a wiping direction WD1 of a wiper 1202 according to a comparative example of this disclosure. FIGS. 19A and 1913 show a wiping direction WD2 of a wiper 202 according to an embodiment of this disclosure.

Here, a configuration is described in which the wiper cleaner (cleaning member) wipes off waste liquid adhering to the wiper.

In the comparative example illustrated in FIGS. 18A and 18B, the wiper 1202 is formed so that the wiper 1202 has a longitudinal direction parallel to a nozzle array direction NAD in which nozzles of a recording head are arrayed in line. Droplets 800 for ejection detection are ejected onto an electrode plate 101, and the wiper 1202 is moved in a wiping direction WD1 perpendicular to the nozzle array direction NAD to wipe the droplets 800 on the electrode plate 101.

At this time, the droplets 800 are an extremely small amount of droplets. Accordingly, when the droplets 800 are wiped in the wiping direction WD1 perpendicular to the nozzle array direction NAD, the liquid droplets 800 on the electrode plate 1101 are not collected together.

As a result, waste liquid adhering to the wiper 1202 may not be fully removed and may firmly adhere to the wiper 1202, resulting in a reduction in wiping performance.

Figure 19A:
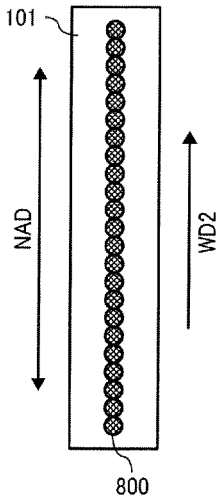
FIG. 19A is a plan view of a wiper during wiping operation according to an embodiment of this disclosure.
Figure 19B:
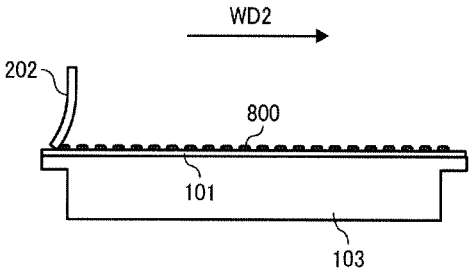
FIG. 19B is a side view of the wiper of FIG. 19A during wiping operation.

By contrast, in this embodiment, as illustrated in FIGS. 19A and 19B, droplets 800 for ejection detection are ejected onto the wiper 222, and the wiper 222 is moved in a wiping direction WD2 parallel to the nozzle array direction NAD to wipe the droplets 800 on the electrode plate 101.

As described above, when the wiper 222 is moved in the wiping direction WD2 parallel to the nozzle array direction NAD to wipe the droplets 800 on the electrode plate 101, the droplets 800 are collected as waste liquid, thus allowing the waste liquid adhering to the wiper 222 to be easily removed from the wiper 222.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus, comprising:

a recording head having a plurality of nozzles to eject droplets and a nozzle face in which the plurality of nozzles is formed;

an ejection detection unit to detect ejection or non-ejection of the droplets from the plurality of nozzles of the recording head, the ejection detection unit having an electrode member disposed in an area in which the electrode member is opposable to the recording head, the electrode member on which the droplets ejected from the plurality of nozzles of the recording head land;

a cleaner to clean the electrode member, the cleaner including a cleaning member to remove droplets adhering to the electrode member, wherein the ejection detection unit detects ejection or non-ejection of the droplets from the plurality of nozzles by detection of electric changes of the electrode member generated when the droplets ejected from the plurality of nozzles of the recording head land on the electrode member in a state in which a potential difference is created between the nozzle face of the recording head and the electrode member and the nozzle face of the recording head is opposed to the electrode member; and a holder member to support the electrode member, and hold the cleaning member movable in parallel to a nozzle array direction in which the plurality of nozzles is arrayed in the recording head.

2. The image forming apparatus of claim 1, wherein the holder member includes a guide groove, and the cleaning member includes a cleaning portion to contact a surface of the electrode member and a guide portion to hold the cleaning portion and movably engage the guide groove.

3. The image forming apparatus of claim 1, further comprising an absorbing member to absorb liquid, wherein the absorbing member is disposed at a cleaning terminal side at which the cleaning member finishes cleaning the electrode member.

4. The image forming apparatus of claim 1, wherein the cleaning member has a slant surface gradually slanted upward from a leading edge to an opposite side of the leading edge in a cleaning direction of the cleaning member in which the cleaning member moves to remove the droplets on the electrode member.

5. The mage forming apparatus of claim 4, wherein the cleaning member includes an absorbing member to absorb liquid, the absorbing member is disposed on an upper side of the slant surface of the cleaning member.

6. The image forming apparatus of claim 1, wherein the cleaning member includes a wiper to contact and wipe a surface of the electrode member and a wiper holder to hold the wiper movably relative to the holder member.

* * * * *